US007155302B2

(12) United States Patent
Muto et al.

(10) Patent No.: US 7,155,302 B2
(45) Date of Patent: Dec. 26, 2006

(54) EMBROIDERY DATA PRODUCING DEVICE, EMBROIDERY DATA PRODUCING METHOD, EMBROIDERY DATA PRODUCING CONTROL PROGRAM STORED ON COMPUTER-READABLE MEDIUM AND EMBROIDERY METHOD

(75) Inventors: Yukiyoshi Muto, Nagoya (JP); Masahiro Mizuno, Nagoya (JP); Shoichi Taguchi, Nagoya (JP); Mikitoshi Suzuki, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 52 days.

(21) Appl. No.: 11/062,939

(22) Filed: Feb. 23, 2005

(65) Prior Publication Data

US 2005/0234585 A1 Oct. 20, 2005

(30) Foreign Application Priority Data

Mar. 30, 2004 (JP) ..... 2004-099453

(51) Int. Cl.
*D05C 5/04* (2006.01)

(52) U.S. Cl. ..... 700/138

(58) Field of Classification Search ..... 700/138, 700/136, 137; 112/102.5, 470.06, 475.19, 112/470.04
See application file for complete search history.

(56) References Cited

U.S. PATENT DOCUMENTS 5,880,963 A * 3/1999 Futamura ..... 700/138
5,911,182 A * 6/1999 Uyama et al. ..... 112/102.5
6,256,551 B1 * 7/2001 Muto ..... 700/138

FOREIGN PATENT DOCUMENTS

JP A 11-057260 3/1999

* cited by examiner

*Primary Examiner*—Danny Worrell
(74) *Attorney, Agent, or Firm*—Oliff & Berridge, PLC

(57) ABSTRACT

An embroidery data producing device is disclosed producing embroidery data on which an embroidery sewing machine forms an embroidery pattern along another pattern previously formed on cloth held by a cloth holding frame. The embroidery data producing device includes image data producing means for scanning the cloth held by the cloth holding frame to produce pattern image data corresponding to the pattern, and embroidery data producing means for producing embroidery data for forming an embroidery pattern on at least a part of the pattern on the basis of the pattern image data, the embroidery pattern having a size equal to that of the pattern.

22 Claims, 15 Drawing Sheets

EMBROIDERY DATA PRODUCING DEVICE, EMBROIDERY DATA PRODUCING METHOD, EMBROIDERY DATA PRODUCING CONTROL PROGRAM STORED ON COMPUTER-READABLE MEDIUM AND EMBROIDERY METHOD

This application claims priority from JP 2004-099453, filed Mar. 30, 2004, the entire disclosure of which is incorporated herein by reference thereto.

BACKGROUND OF THE INVENTION

1. Field

The disclosure relates to an embroidery -data producing device and method, embroidery data producing control program stored on computer-readable medium and embroidering method for producing embroidery data for making on cloth a piece of embroidery corresponding to a pattern already made on the cloth.

2. Description of the Related Art

Conventional embroidery data producing devices produce outline data on the-basis of image data (or dot pattern data) representative of a figure pattern, obtaining embroidery data by calculation on the basis of the outline data. The embroidery data producing devices include various types. For example, one type of embroidery data producing device is designed to produce outline data of a figure pattern on the basis of previous produced image data. Another type of embroidery data producing device is designed to read a figure pattern drawn on paper or the like by an image scanner to produce image data, further producing outline data on the basis of the read image data.

Japanese Patent Application Laid-Open No. 11-57260 discloses one of the conventional embroidery data producing devices. The disclosed embroidery data producing device comprises a control body, a CRT display, a flexible disc drive unit, an image scanner, etc., latter three being connected to the control body. This embroidery data producing device reads a figure pattern drawn on paper or the like by an image scanner to produce image data, further producing embroidery data on the basis of the produced image data. Further, when the figure pattern has a size larger than an embroidery region of an embroidery sewing machine, the figure pattern is divided into several sewing regions and embroidery data is produced for every figure part.

On the other hand, a figure or design according to a pattern drawn on a piece of cloth is sometimes embroidered on the cloth in order that the pattern may be rendered three-dimensional or luxurious. In such a case, the pattern is scanned by an image scanner so that image data is produced.

However, a tension of the cloth in a case where a pattern is read by the image scanner sometimes differs from a tension of the cloth held by a cloth holding frame. In this case, the size of the pattern represented by image data does not correspond with the size of the pattern on the cloth held by the frame. As a result, there occurs a difference between embroidery formed on the cloth on the basis of the embroidery data and the pattern of the cloth. Further, the difference also occurs when a posture of the pattern during read by an image scanner differs from a posture of the pattern in a case where the cloth has been held by the frame.

SUMMARY

Therefore, an object of the disclosure is to provide an embroidery data producing device which can produce embroidery data on which an embroidery pattern corresponds with a pattern previously formed on cloth when embroidery is sewn on the pattern of the cloth.

The disclosure provides an embroidery data producing device producing embroidery data on which an embroidery sewing machine forms an embroidery pattern along another pattern previously formed on cloth held by a cloth holding frame. The device comprises image data producing means for scanning the cloth held by the cloth holding frame to produce pattern image data corresponding to the another pattern, and embroidery data producing means for producing embroidery data for forming an embroidery pattern on at least a part of the pattern on the basis of the pattern image data, the embroidery pattern having a size equal to that of the another pattern.

In the above-described device, the pattern on the cloth is read while the cloth is held by the cloth holding frame. Image data of the pattern is produced, and embroidery data is produced on the basis of the pattern image data. In this case, the size of the embroidery pattern formed on the basis of the embroidery data is adapted to become equal to that of the pattern of the cloth. Consequently, fine embroidery can be sewn on the pattern of the cloth without stitches being formed outside of the pattern.

In a preferred form, at least either one of the cloth holding frame and the cloth held by the cloth holding frame has a coordinate indicating mark indicative of a rectangular coordinate system in the embroidery sewing machine. The image data producing means scans the cloth holding frame and the cloth to produce mark image data corresponding to the coordinate indicating mark, and the embroidery data producing means is provided with image data transforming means for transforming the pattern image data into image data in the rectangular coordinate system on the basis of the mark image data and the pattern image data. In this case, the embroidery data producing means produces embroidery data on the basis of the image data transformed into the rectangular coordinate system.

In another preferred form, the embroidery data producing means is provided with outline data producing means for producing outline data defining an outline of the pattern in the rectangular coordinate system on the basis of the mark image data and the pattern image data. In this case, the embroidery data producing means produces embroidery data on the basis of the outline data.

In the above-described device, an embroidery pattern the embroidery sewing machine produces on the basis of embroidery data can accurately be positioned so as to correspond to a pattern of the cloth with no relation to an inclination of the pattern when the pattern of the cloth held by the cloth holding frame is read.

BRIEF DESCRIPTION OF THE DRAWINGS

Other objects, features and advantages will become clear upon reviewing the following description of embodiment with reference to the accompanying drawings, in which.

DETAILED DESCRIPTION OF THE INVENTION

One embodiment of the embroidery data producing device, method and program in accordance with the disclosure will be described with reference to the accompanying drawings. The program is stored on a computer-readable medium. In the following embodiment, a pattern previously printed on a piece of cloth held by a cloth holding frame is read by an image scanner so that image data is produced. Embroidery data is produced on the basis of the image data and a resolution. The embroidery data is usable for forming an embroidery pattern having a size equal to the pattern, on at least a part of the pattern.

Figure 1:
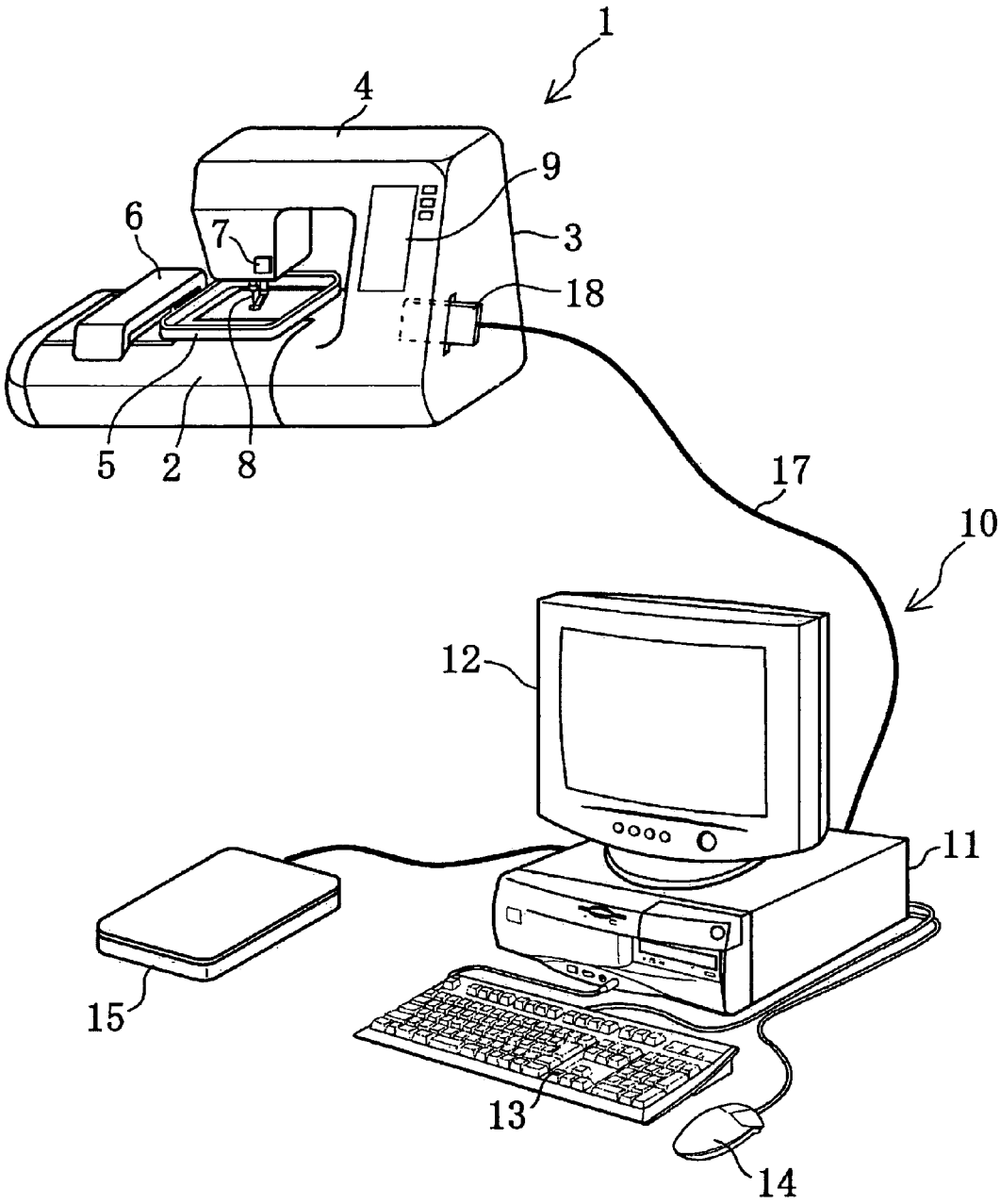
FIG. 1 is a perspective view of an embroidery sewing machine and an embroidery data producing device in accordance with one embodiment.

Referring first to FIG. 1, the embroidery sewing machine and the embroidery data producing device will be described. The embroidery sewing machine 1 has a construction similar to that of a household electronic sewing machine. The embroidery sewing machine 1 comprises a sewing bed 2, pillar 3 and arm 4. The sewing bed 2 is provided with a loop-taker (not shown), a frame driving mechanism 6 for moving a cloth holding frame 5 in the X and Y directions and the like.

A switch 7 for commanding sewing start is provided on a front face of the arm 4. A drive shaft, needle bar driving mechanism and needle bar are provided inside the arm 4 although none of them are shown. A sewing needle 8 is attached to a lower end of the needle bar. When the drive shaft is turned by a motor (not shown), the needle bar and needle 8 are moved up and down by the needle bar driving mechanism.

Figure 6:
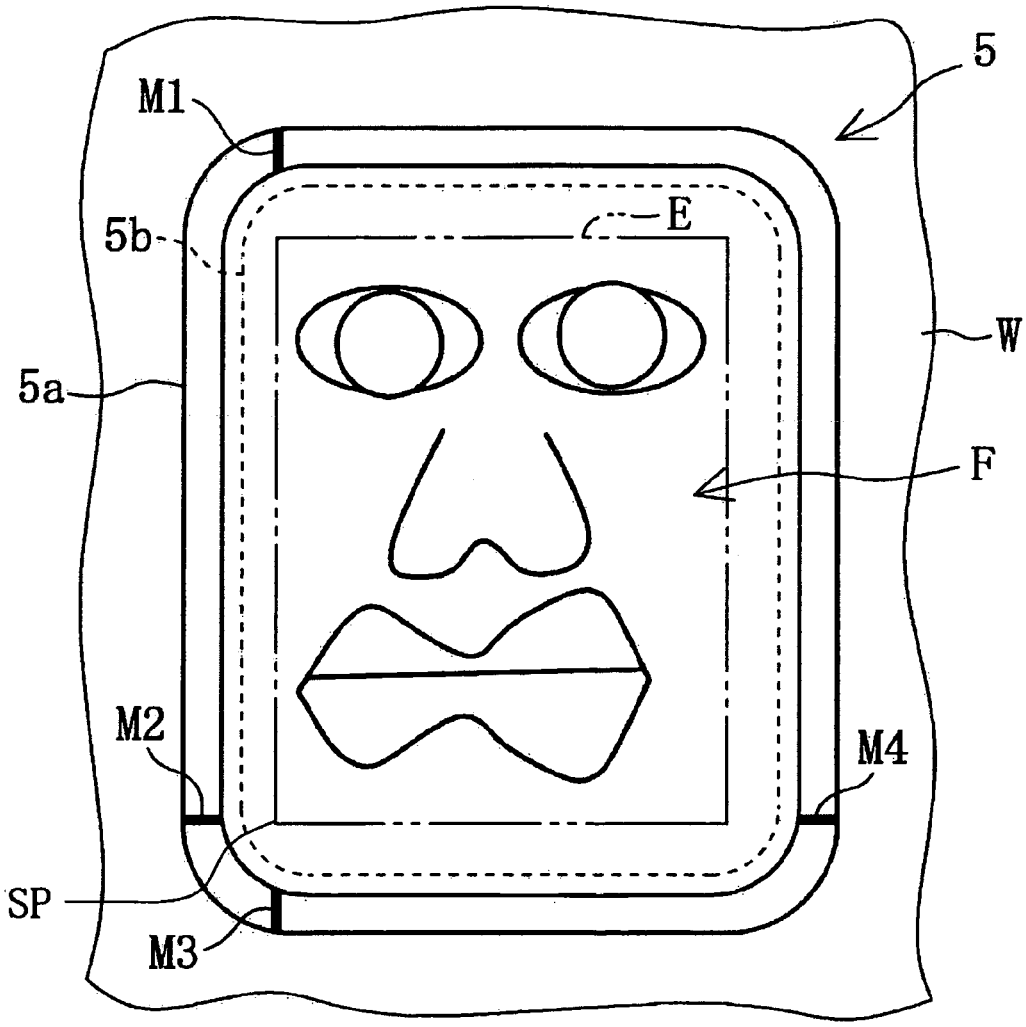
FIG. 6 is a plan view of a cloth holding frame on which cloth is held.

The cloth holding frame 5 includes an outer frame 5*a* coupled to the frame driving mechanism 6 and an inner frame 5*b* fitted in the outer frame 5*a* as shown in FIG. 6. Cloth W (handkerchief or blouse, for example) to be sewn is placed on the inner frame 5*b*. In this state, the outer frame 5*a* is fitted with an outer circumference of the inner frame 5*b* from over the cloth W, so that the cloth W is held by the cloth holding frame 5. When the cloth holding frame 5 holding the cloth W has been set on the frame driving mechanism 6, the cloth W inside the cloth holding frame 5 is located slightly higher than an upper face of the bed 2. The cloth holding frame 5 has such a smaller thickness that embroidery can be formed on the cloth W.

A liquid-crystal display 9 provided with a transparent touch panel is mounted on a front face of the pillar 3 as shown in FIG. 1. The liquid-crystal display 9 has a color display function. Further, a connector code 17 is connected to a control device 20 of an embroidery data producing device 10. The connector code 17 has a connector 18 connected to a right portion of the pillar 3. The embroidery sewing machine 1 receives embroidery data transmitted through the connecting code 17 from the embroidery data producing device 10. The embroidery sewing machine 1 controls X-direction and Y-direction drive motors of the frame driving mechanism on the basis of the embroidery data, so that the cloth holding frame 5 coupled to the frame driving mechanism 6 is moved in the X and Y directions.

The embroidery data producing device 10 comprises a personal computer 11, display 12, keyboard 13, mouse 14 and image scanner 15. As will be described in detail later, a pattern F is read by the image scanner 15, and image data is produced on the basis of the read pattern F. Embroidery data is produced on the basis of the image data.

Figure 2:
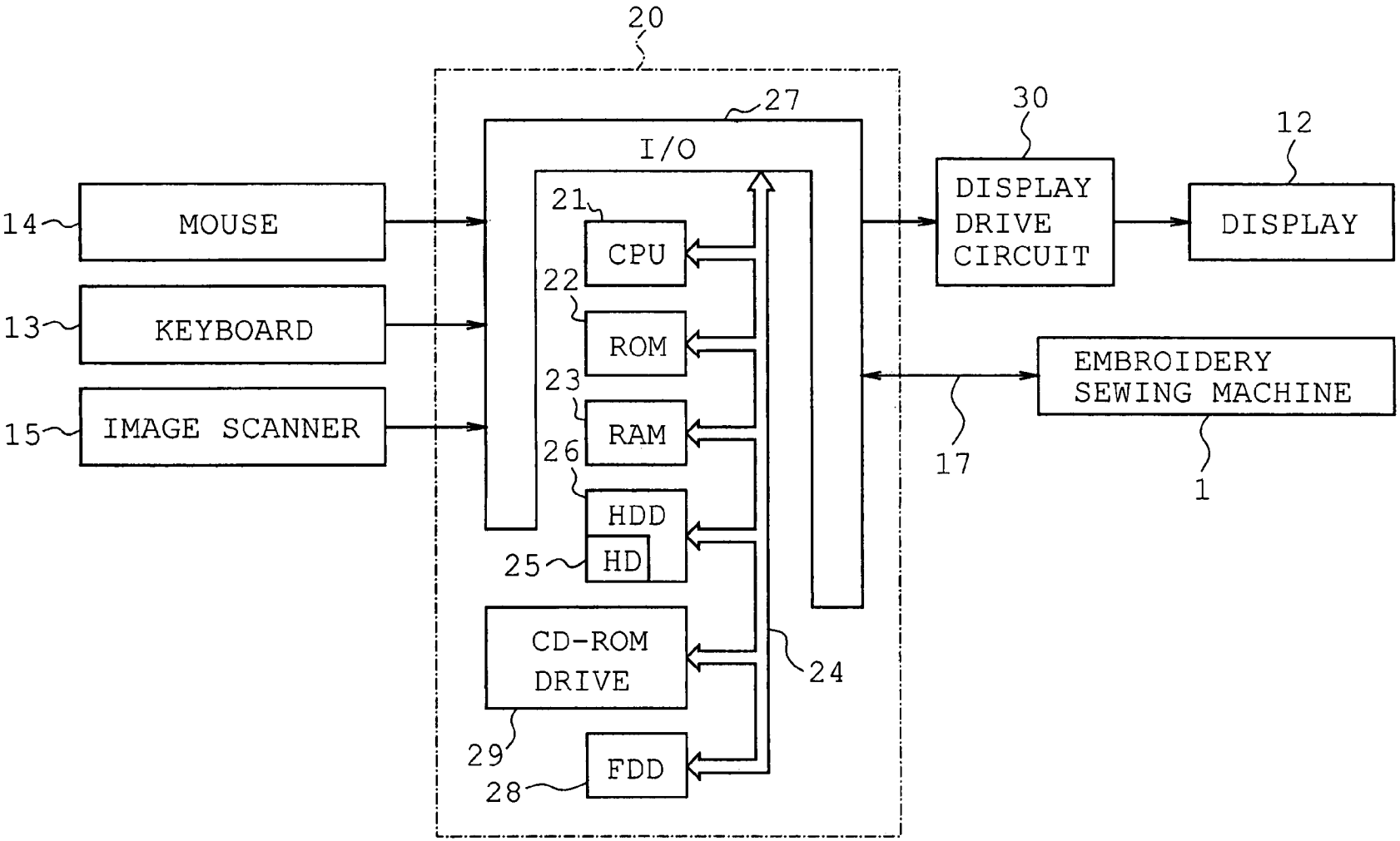
FIG. 2 is a block diagram showing a control system of the embroidery data producing device.

FIG. 2 is a block diagram showing a control system of the embroidery data producing device 10. In FIG. 2, the control device 20 is provided in the personal computer 11 and controls the entire embroidery data production. The control device 20 comprises a microcomputer including CPU 21, ROM 22, RAM 23 and bus 24 connecting the former devices, a hard disk drive (HDD) 26 connected to the bus 24 and provided with a hard disk (HD) 25, and an input/output interface 27.

A flexible disk drive (FDD) 28 and a CD-ROM drive 29 are connected to the bus 24. Further, to the input/output interface 27 is connected the keyboard 13, mouse 14, image scanner 15 and display drive circuit 30 for driving the display 12. The sewing machine 1 is also connected via the connecting code 17 to the input/output interface 27.

ROM 22 stores a starting program for starting the personal computer 11 when it is turned on, and the like. On the other hand, the hard disk 25 is incorporated with an operating system (OS), various drivers for rendering the display 12, keyboard 13, mouse 14, image scanner 15, etc. usable, application program and the like. The hard disk 25 further stores various control programs such as an embroidery data producing program, which will be described later.

Figure 5:
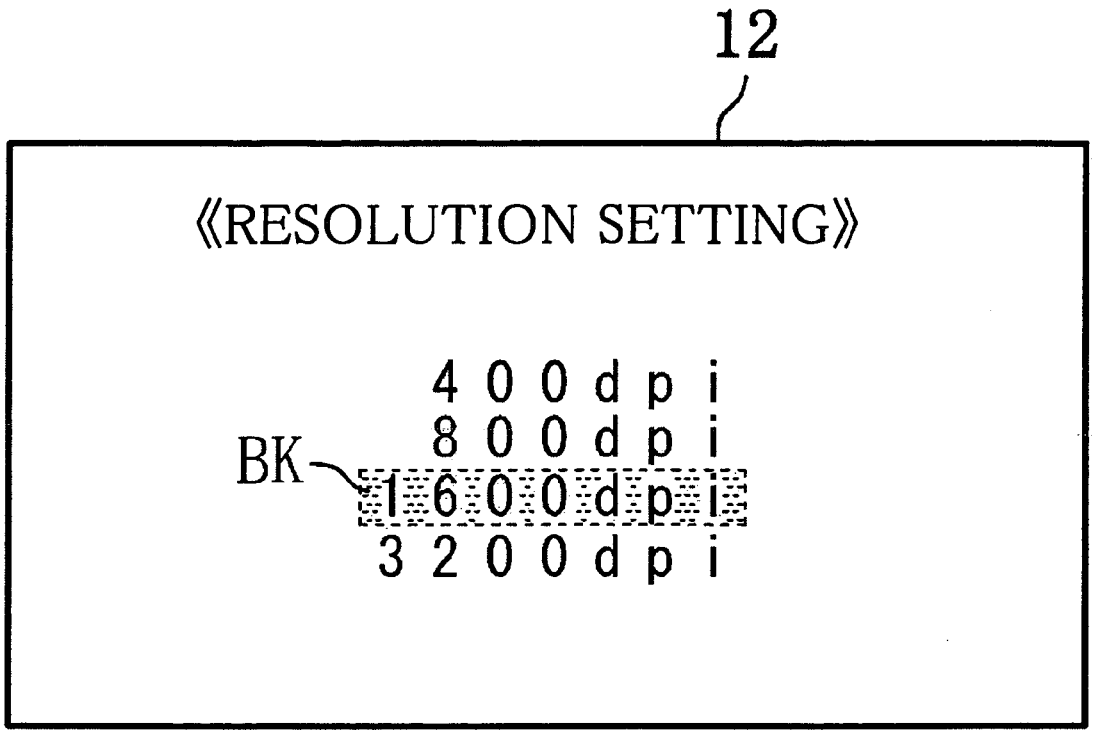
FIG. 5 shows an example of contents displayed on a resolution setting screen of the display.

Image data produced on the basis of an image read by the image scanner 15 is stored on the hard disk 25. Embroidery data (stitch data) produced on the basis of the image data is also stored on the hard disk 25. The image scanner 15 is settable at any one of four resolution values (400 dpi, 800 dpi, 1600 dpi and 3200 dpi) when reading an image. FIG. 5 shows a resolution setting screen on the display 12. On the resolution setting screen, a block cursor BK is moved to a character indicative of a desired resolution for the purpose of setting the resolution.

Figure 3:
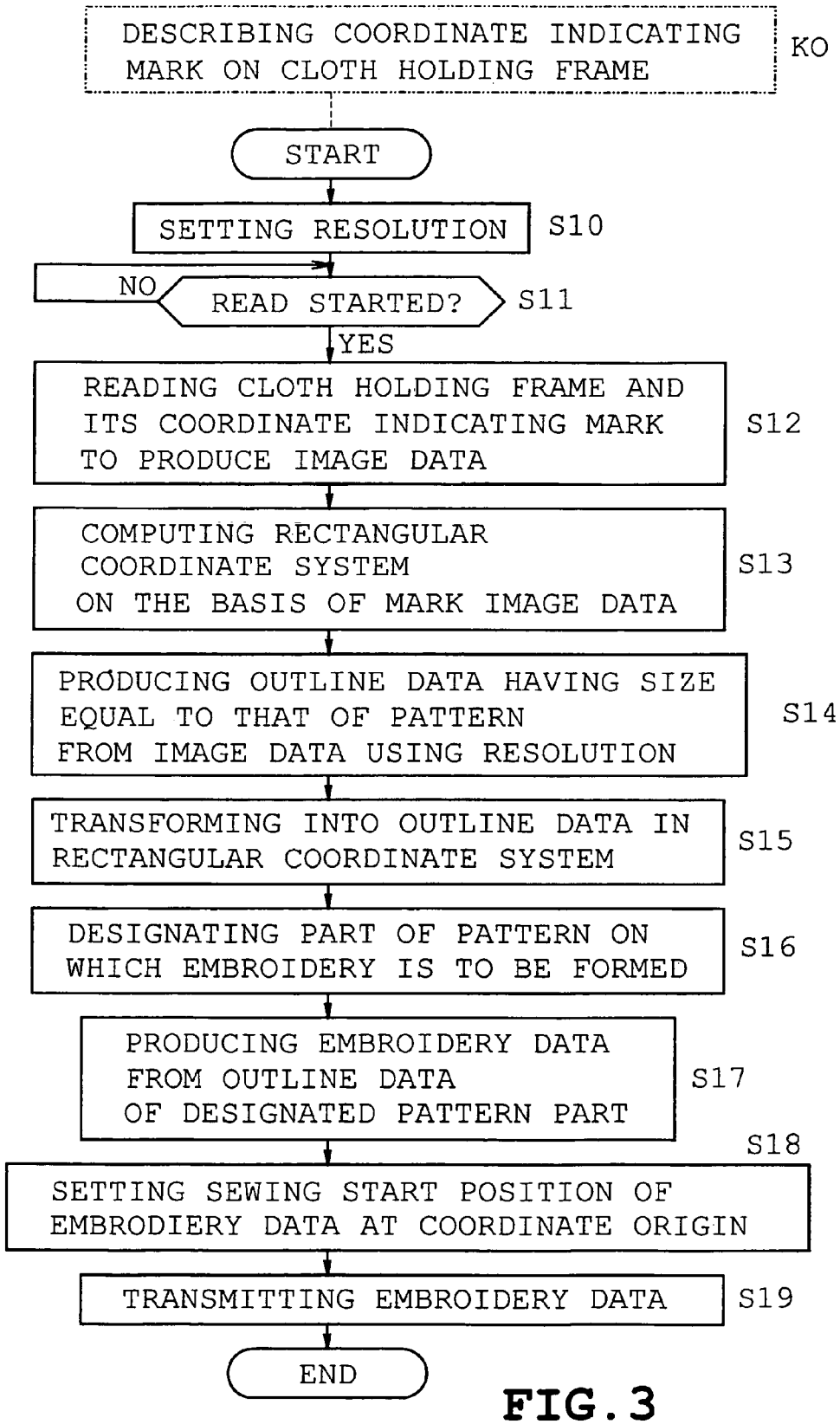
FIG. 3 is a flowchart showing an embroidery data producing process.

A process of producing embroidery data will now be described with reference to FIG. 3, which shows a control program for an embroidery data producing process. Reference symbol Si (where i=10, 11, 12, 13 and . . . ) designates each step of the embroidery data producing process. Firstly, a previous step designated by "K0" will be described. The previous step K0 is executed before the embroidery data producing process starts. A coordinate indicating mark M is formed on the cloth holding frame 5 using a readable ink in the previous step K0. For example, as shown in FIG. 6, the coordinate indicating mark M is composed of coordinate indicating marks M1 to M4 formed on four positions on the cloth holding frame 5 respectively. In this case, the coordinate indicating marks M1 to M4 indicate two intersecting directions. More specifically, the coordinate indicating marks M2 and M4 indicate the X direction (transverse direction with respect to the cloth holding frame 5), whereas the coordinate indicating marks M1 and M3 indicate the Y direction (longitudinal direction with respect to the cloth holding frame 5). The X and Y directions correspond to the directions in which the cloth holding frame 5 is moved by the frame driving mechanism 6.

Particularly in the embodiment, when reference symbol "E" designates a rectangular sewing region previously set in the cloth holding frame 5, a line passing through the coordinate indicating marks M2 and M4 indicates a lower limit line of the sewing region E, whereas a line passing through the coordinate indicating marks M1 and M3 indicates a left limit line of the sewing region E. Further, an intersection of the lines passing through the marks M1 and M3 and M2 and M4 indicates a specified position SP which is a lower left corner of the sewing region E as viewed in FIG. 6.

Upon completion of the previous step K0, the cloth holding frame 5 holding the cloth W is set on the image scanner 15. It is now assumed that a pattern F of a human face including eyes, a nose and a mouth as shown in FIG. 6 is printed on the cloth W. The cloth holding frame 5 is set on the image scanner 15 so that the side of the cloth W on which the pattern F is printed confronts a reading or scanning face of the image scanner 15. Subsequently, by key operation on the keyboard 13 or on a menu screen on the display 12, an item of "producing embroidery data" is pointed by the mouse 14, which is then clicked once so that the embroidery data producing process starts.

Firstly, the resolution during data read is set (S10). As described above, the resolution is set by pointing a desired one of the four resolution values on the resolution setting screen on the display 12, for example, the resolution of 1600 dpi is pointed by the block cursor BK (see FIG. 5). When an EXECUTION key on the keyboard 13 is operated so that start of reading is instructed (YES at S11), the cloth holding frame 5, coordinate indicating marks M1 to M4 and pattern F are read so that image data of the cloth holding frame 5, coordinate indicating marks M1 to M4 and pattern F are produced (S12).

Figure 7:
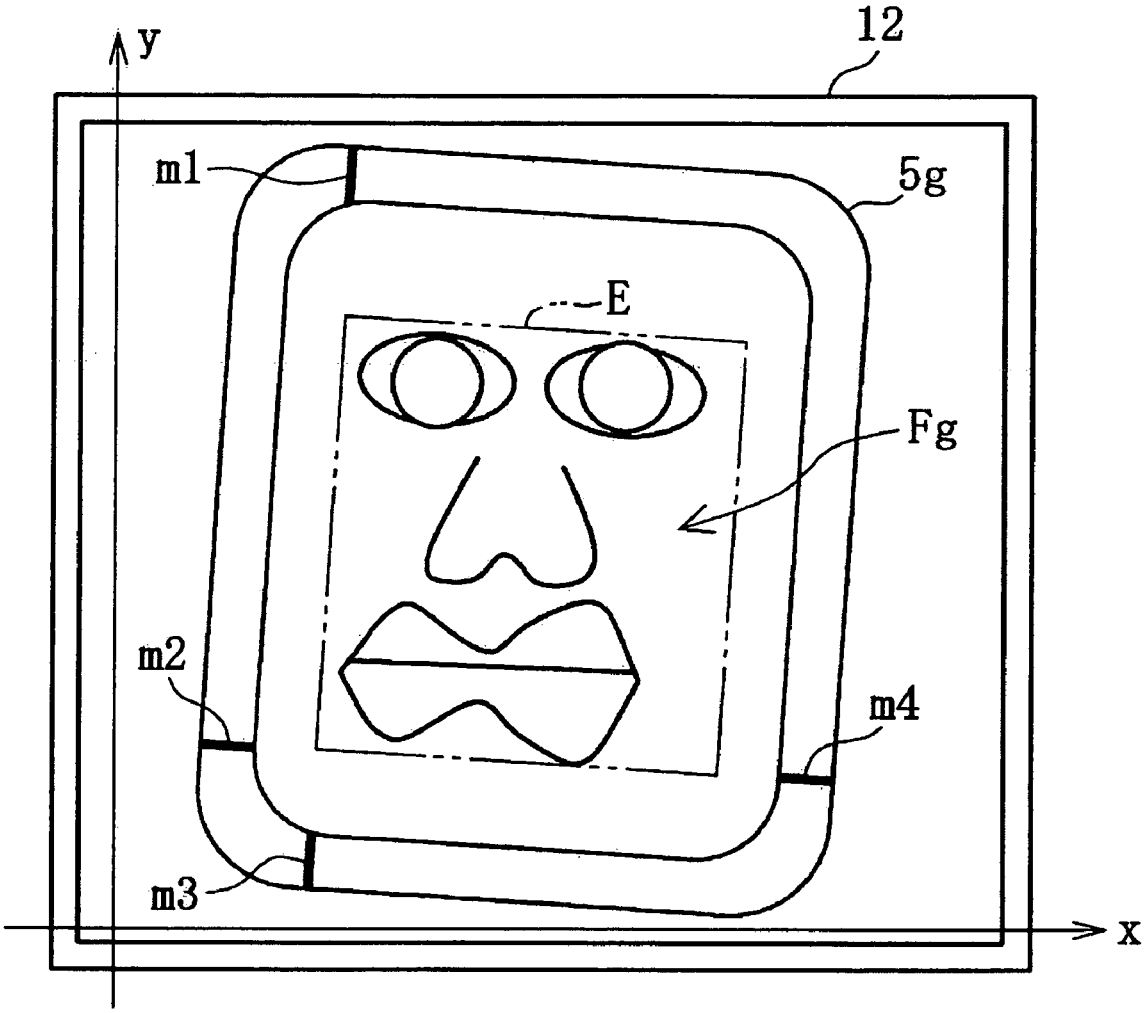
FIG. 7 shows an example of contents displayed on the basis of a coordinate indicating mark, pattern and image data of cloth holding frame.

In this case, for example, as shown in FIG. 7, images of the cloth holding frame 5g, coordinate indicating marks ml to m4 and pattern Fg are displayed on the display 12 on the basis of the image data of the cloth holding frame 5, coordinate indicating marks M1 to M4 and pattern F respectively. The image scanner 15 is set with an original coordinate system (xy coordinate system) comprising x and y axes and used in the read. Accordingly, the cloth holding frame 5g and coordinate indicating marks m1 to m4 are displayed on the display 12 with an inclination according to attitude of the cloth holding frame 5 set on the image scanner 15.

At step S13, a rectangular coordinate system (XY coordinate system) in the frame driving mechanism 6 or in the embroidery sewing machine 1 is computed on the basis of image data of the coordinate indicating marks M1 to M4. In this case, the X axis of the rectangular coordinate system is obtained on the basis of the image data of the coordinate indicating marks M2 and M4, whereas the Y axis of the rectangular coordinate system is obtained on the basis of the image data of the coordinate indicating marks M1 and M3. More specifically, the line passing through the coordinate indicating marks m2 and m4 serves as the X axis and the line passing through the coordinate indicating marks m1 and m3 serves as the Y axis.

Figure 8:
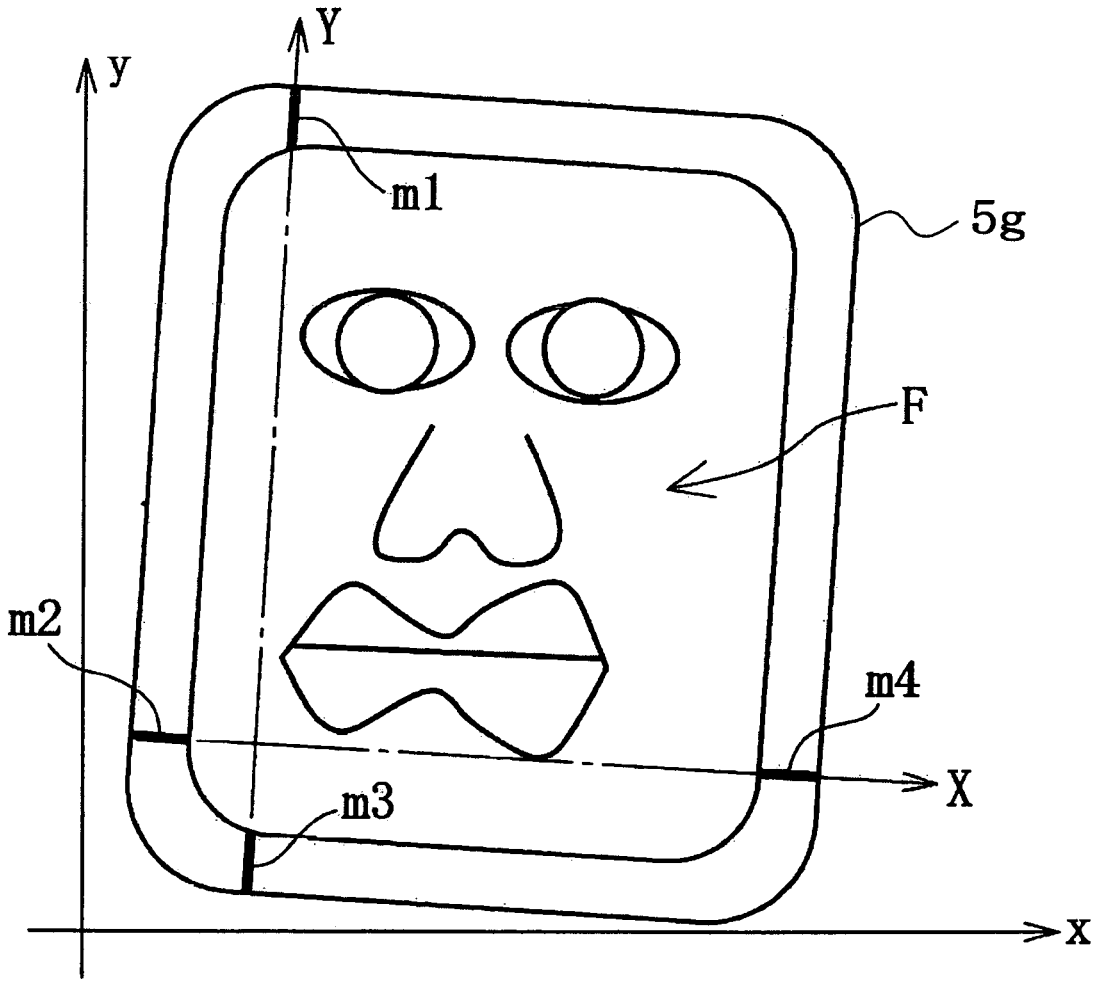
FIG. 8 shows the relationship between outline data of the pattern in the xy coordinate system and the xy coordinate system.

At step S14, outline data is produced on the basis of the image data of pattern F and resolution. The resolution value previously set in the image scanner 15 is applied to the number of dots per inch with respect to the outline data and then, outline data having a size equal to that of the pattern F is computed. Since the outline data producing process on the basis of image data is known in the art, concrete description of the process is eliminated. FIG. 8 shows an example of displayed outline of the pattern F in the xy coordinate system with X and Y axes. FIG. 8 also shows the cloth holding frame 5g and coordinate indicating marks m1 to m4.

Figure 9:
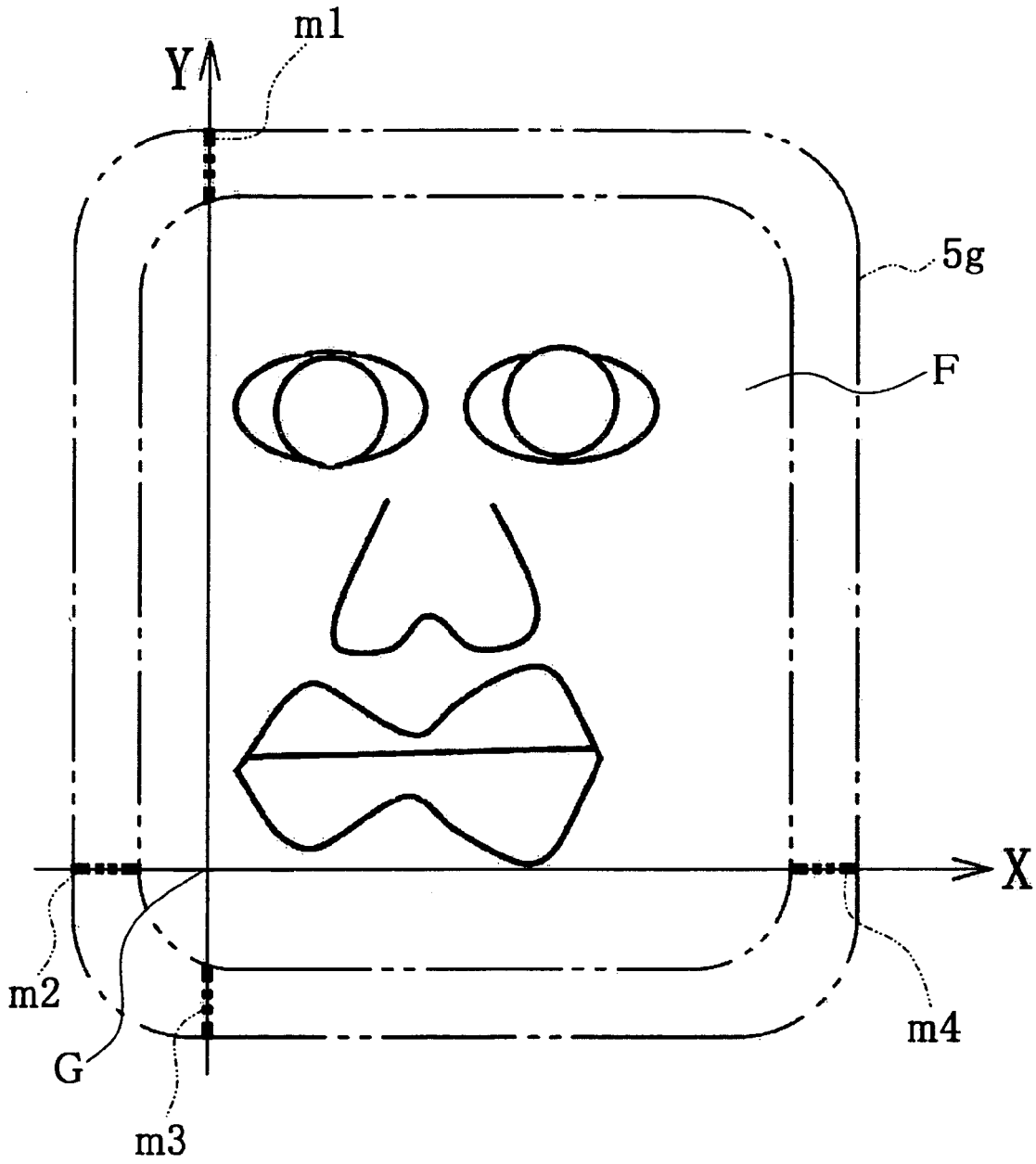
FIG. 9 shows an example of contents displayed on the basis of outline data of the pattern after the coordinate transformation.

At step S15, coordinate transformation is carried out, that is, the outline data in the xy coordinate system is transformed into outline data in the rectangular coordinate system (XY coordinate system) obtained at step S13. FIG. 9 shows an example of displayed outline of pattern F on the basis of the outline data transformed into the XY coordinate system, together with XY coordinate axes. FIG. 9 also shows, by two-dot chain line, the cloth holding frame 5g and coordinate indicating marks m1 to m4 after transformation into the XY coordinate system.

Figure 10:
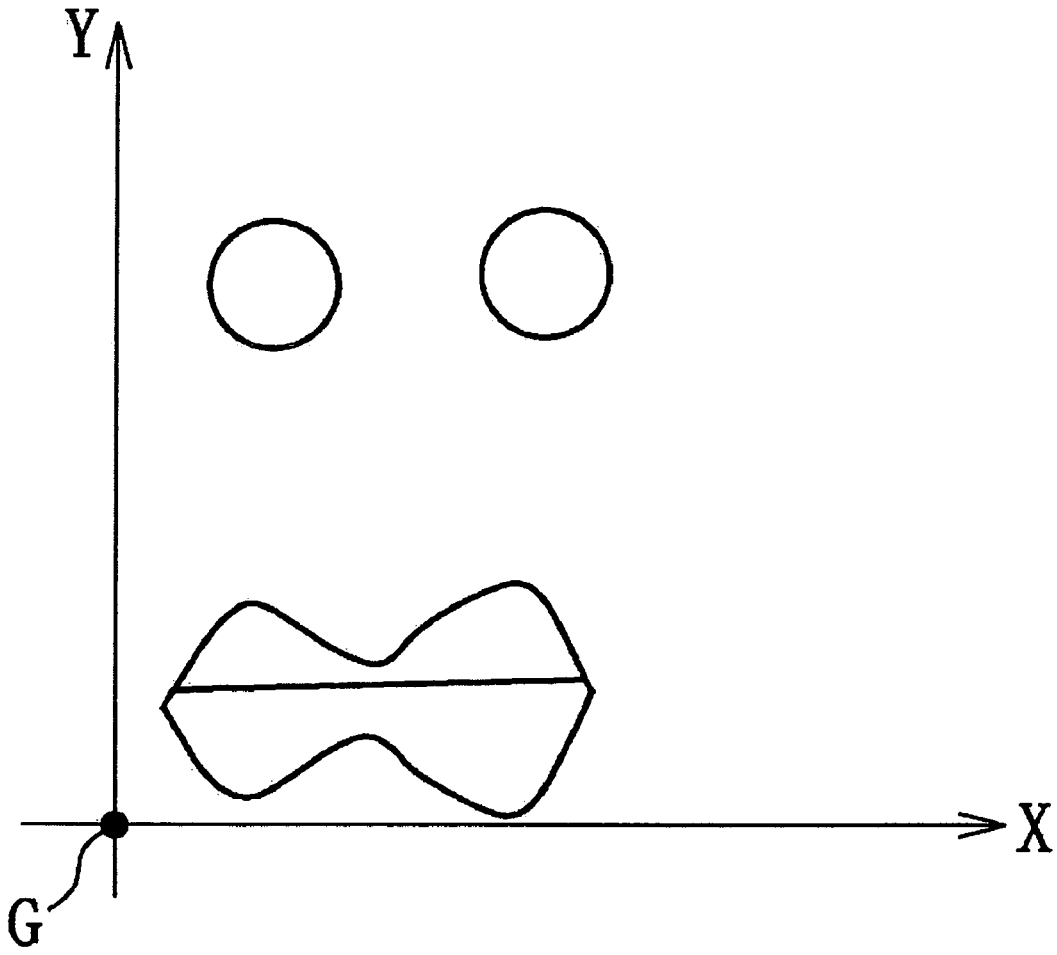
FIG. 10 shows outline data of a designated part of the pattern.

At step S16, a process is carried out to designate a pattern part which becomes an object of embroidery sewing out of the outline of pattern F on the display 12. In the pattern part designating process, for example, the mouse 14 is operated so that a marker (not shown) displayed on the display 12 is moved to point a part of outline of the pattern F, on which part an embroidery is sewn. FIG. 10 shows a case where the eyes and mouth of the outline of the pattern F have been designated as parts on which embroidery sewing is carried out.

Figure 11:
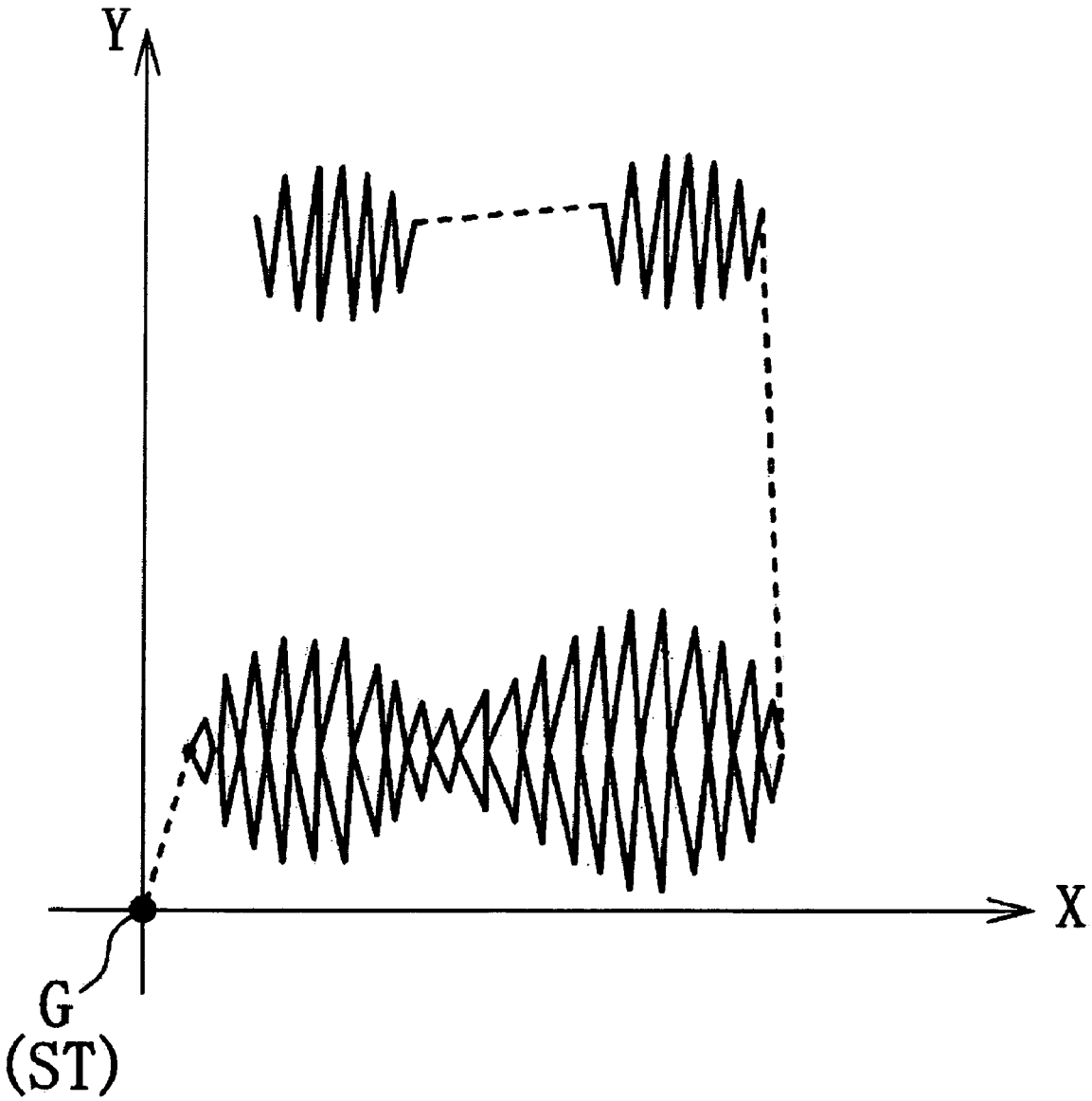
FIG. 11 shows embroidery data of a designated part of the pattern.

At step S17, embroidery data is produced from outline data of the parts designated at step S16. Since a technique for producing embroidery data from outline data is known in the art, the description of the technique is eliminated. As shown in FIG. 11, consecutive embroidery data is produced in the sequence of "mouth," "right eye" and "left eye."

A sewing start position of embroidery data is usually set at the center of the sewing region E. In the embodiment, however, the specified position SP indicated by the coordinate indicating marks M1 to M4 is determined as a sewing start position. Since the specified position SP is set at a lower left corner of the sewing region E, that is, an origin G of the XY coordinate system, a process is carried out to change a sewing start position ST of embroidery data to the origin G of the XY coordinate system (S18). Further, sewing start position data is produced on the basis of the changed sewing start position ST and located at the head of embroidery data. A needle drop location of each embroidery data is changed on the basis of the sewing start position data (see FIG. 11). At step S19, the produced embroidery data is transmitted through the connecting code 17 to the embroidery sewing machine 1. Thus, the embroidery data producing process is completed.

Figure 4:
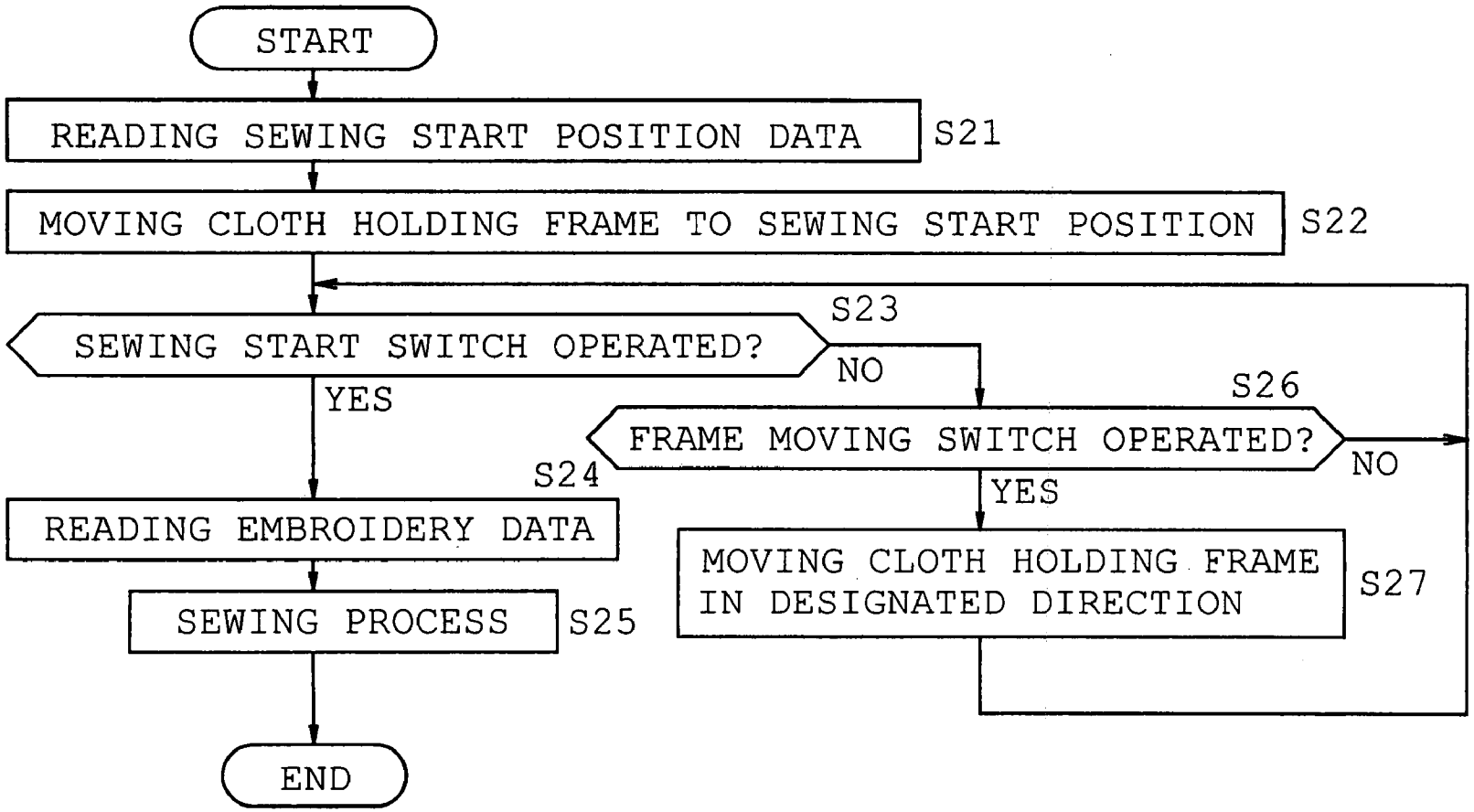
FIG. 4 is a flowchart showing an embroidery sewing process in the embroidery sewing machine.

An embroidery sewing process to be executed by the embroidery sewing machine 1 will now be described with reference to FIG. 4. When the cloth holding frame on which the cloth W is set is coupled to the frame driving mechanism 6 and sewing start is instructed, the sewing start position data accompanying the embroidery data is read in (S21). The cloth holding frame 5 is then moved on the basis of the sewing start position data so that the sewing needle 8 is located at the sewing start position ST (S22).

In the above-described case, when the position of the sewing needle 8 does not correspond with the specified position SP indicated by the coordinate indicating marks M1 to M4, a frame moving switch provided on the touch panel 9 of the liquid-crystal display 9 is operated (YES at S26) so that the cloth holding frame 5 can be moved in a designated direction (S27). Thus, the position of the cloth holding frame 5 is finely controlled. The sewing start position ST is set at the specified position SP which is a lower left part of the sewing region E in the embodiment. The specified position SP is indicated by the coordinate indicating marks M1 to M4. Thus, since the specified position ST is easy to recognize, movement of the frame can be simplified at the time of sewing start.

Figure 12:
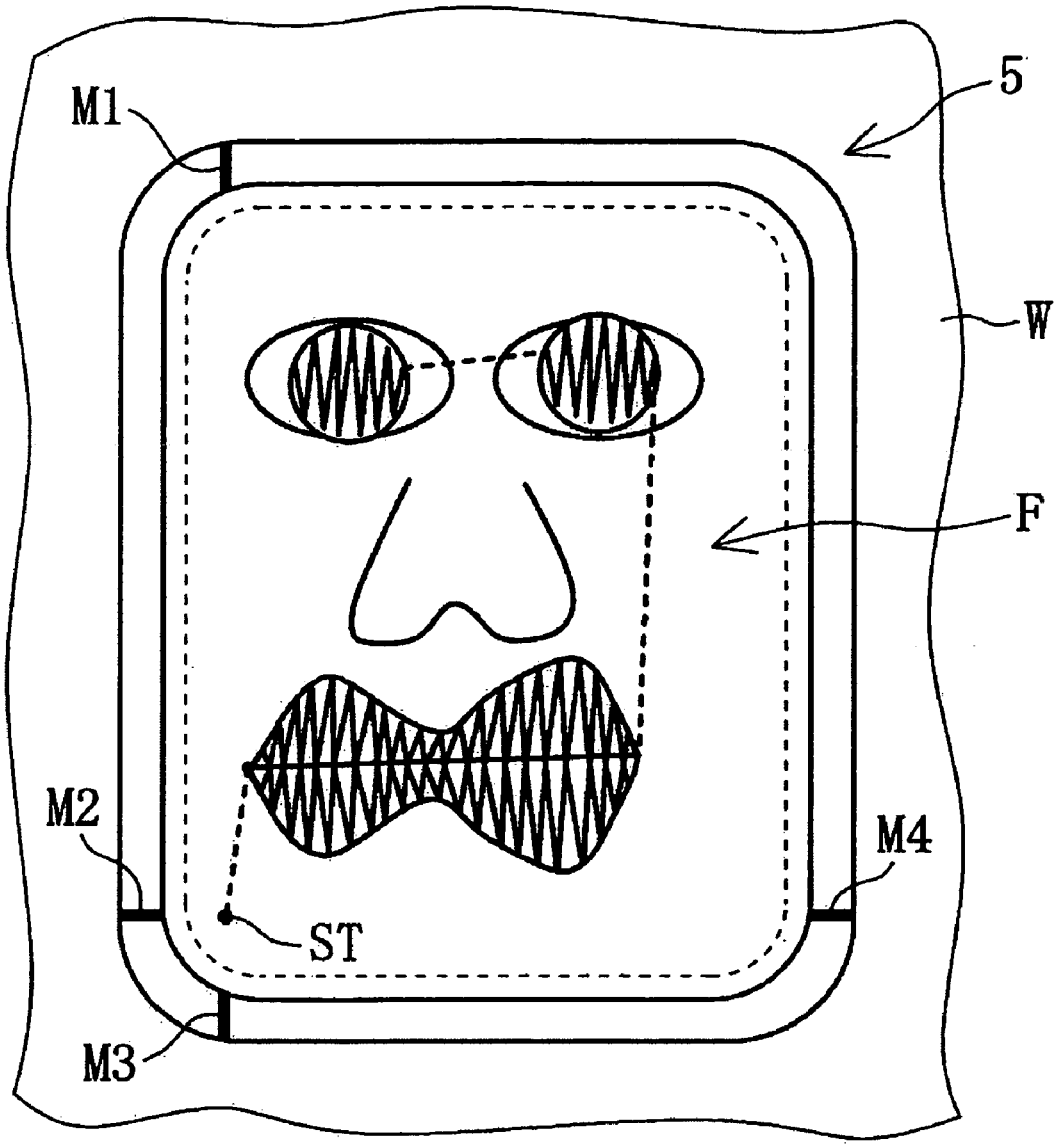
FIG. 12 is a plan view of cloth on which embroidery is sewn on the pattern part and the cloth holding frame.

When the sewing start key 7 is operated (YES at S23), embroidery data related to the pattern part is read in (S24) and the sewing process is carried out (S25). Thus, the embroidery sewing control is finished. As a result, embroidery stitches are formed on the portions of "mouth," "right eye" and "left eye" of the pattern F as shown in FIG. 12.

The following effect can be achieved from the foregoing embodiment. The pattern F drawn on the cloth W is read by the image scanner 15 while the cloth W is held on the cloth holding frame 5. The image data is produced on the basis of the read pattern F. The embroidery data is produced on the basis of the produced image data. The embroidery pattern formed on the basis of the embroidery data has a size equal to that of the pattern F read by the image scanner 15. Accordingly, the size of embroidery pattern formed on the basis of the produced embroidery data corresponds with the size of the pattern of the target embroidery drawn on the cloth. Consequently, fine embroidery can be sewn on the pattern of the cloth without stitches being formed outside of the pattern.

Further, the coordinate indicating marks M1 to M4 are previously formed on the cloth holding frame 5, and the image scanner 15 reads the coordinate indicating marks M1 to M4 together with the pattern F, producing the mark image data. The rectangular coordinate system (XY) is obtained on the basis of the mark image data. The outline data is produced on the basis of the image data of pattern F. The coordinate transformation is carried out so that the outline data is transformed to the outline data in the rectangular coordinate system (XY). The embroidery data is produced from the transformed outline data. Accordingly, the embroidery data in the rectangular coordinate system (XY) in the embroidery sewing machine 1 can be produced. Consequently, the inclination of the pattern F can be corrected when the pattern F is read by the image scanner 15 and accordingly, the embroidery pattern formed on the basis of the embroidery data can accurately be positioned so as to correspond to a pattern to be embroidered of the cloth with no relation to an inclination of the pattern.

Further, the step (S16) is provided in which any part of the pattern F read by the image scanner 15 is designated as the pattern part on which the embroidery is to be formed. Consequently, embroidery date can be produced so as to correspond to any part of the whole pattern F.

Figure 13:
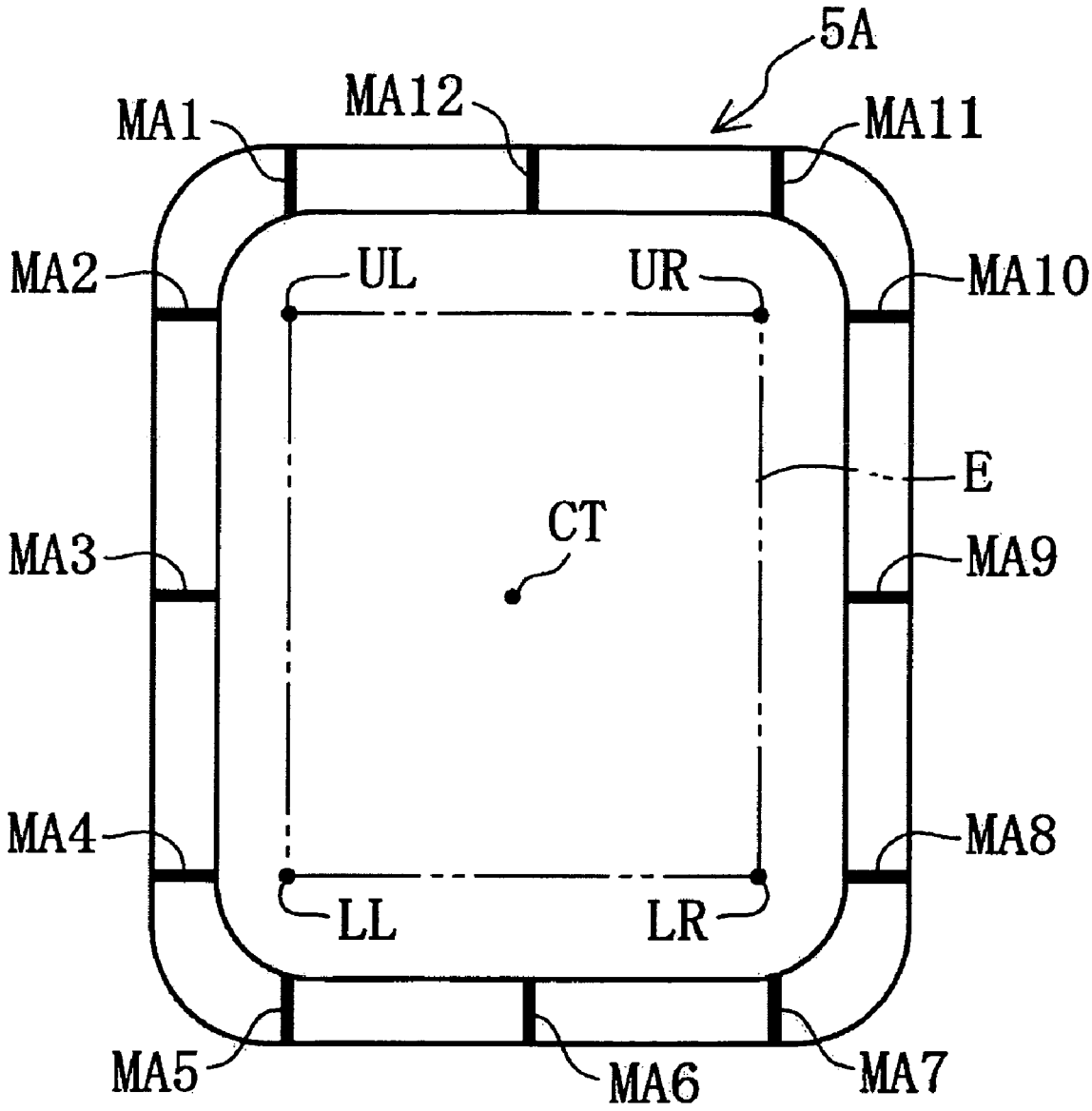
FIG. 13 is a plan view of the cloth holding frame on which a coordinate indicating mark is formed, showing a first modified form of the foregoing embodiment.

The invention should not be limited to the above-describe embodiment but may be modified as follows:

1. The coordinate indicating mark formed on the outer frame 5A of the cloth holding frame 5 may comprise any group of four of twelve marks as shown in FIG. 13. More specifically, a group of coordinate indicating marks MA1, MA4, MA5 and MA8 corresponds to the group of coordinate indicating marks M1 to M4 as described above and designate the lower left LL of the sewing region E as the sewing start position. Further, when the lower right LR of the sewing region E is designated as the sewing start position, a group of coordinate indicating marks MA4, MA7, MA8 and MA11 is formed on the outer frame 5A. When the upper left UL of the sewing region E is designated as the sewing start position, a group of coordinate indicating marks MA1, MA2, MA5 and MA10 is formed on the outer frame 5A. When the upper right UR of the sewing region E is designated as the sewing start position, a group of coordinate indicating marks MA2, MA7, MA10 and MA11 is formed on the outer frame 5A. When the center CT of the sewing region E is designated as the sewing start position, a group of the coordinate indicating marks MA3, MA6, MA9 and MA12 is formed on the outer frame 5A.

Figure 14:
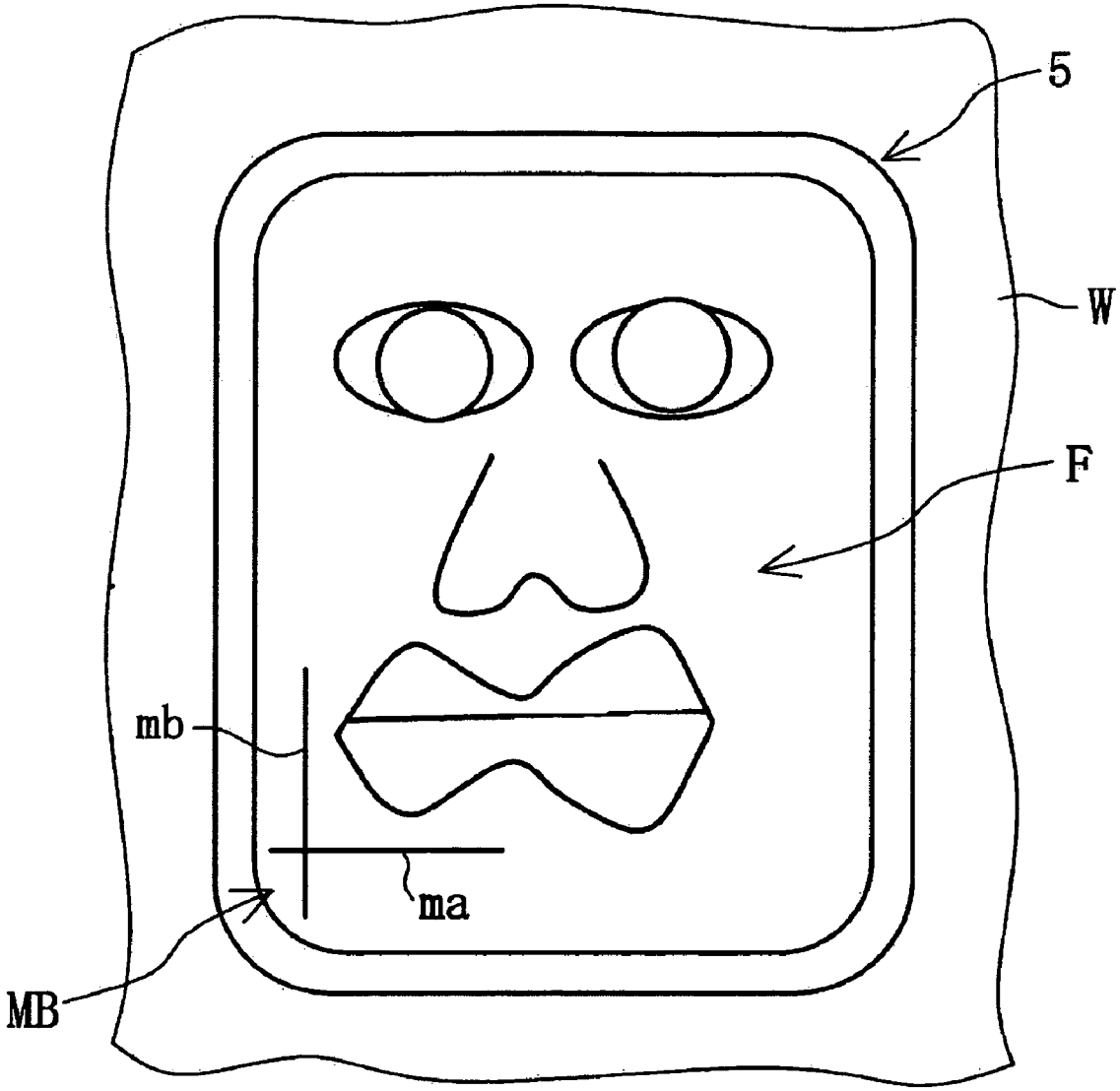
FIG. 14 is a plan view of the cloth holding frame holding the cloth formed with a coordinate indicating mark, showing a second modified form of the foregoing embodiment.

2. As shown in FIG. 14, the coordinate indicating mark MB may be formed directly on the cloth W with an erasable color pencil such charcoal pencils. In this case, the coordinate indicating mark MB may be formed into the shape of a cross and include a transverse line ma and a longitudinal line mb so that the transverse and longitudinal directions can be indicated. In the aforementioned case, too, the coordinate indicating mark MB is read by the image scanner 15, and crossed mark image data is produced, whereupon the rectangular coordinate system can be defined.

Figure 15:
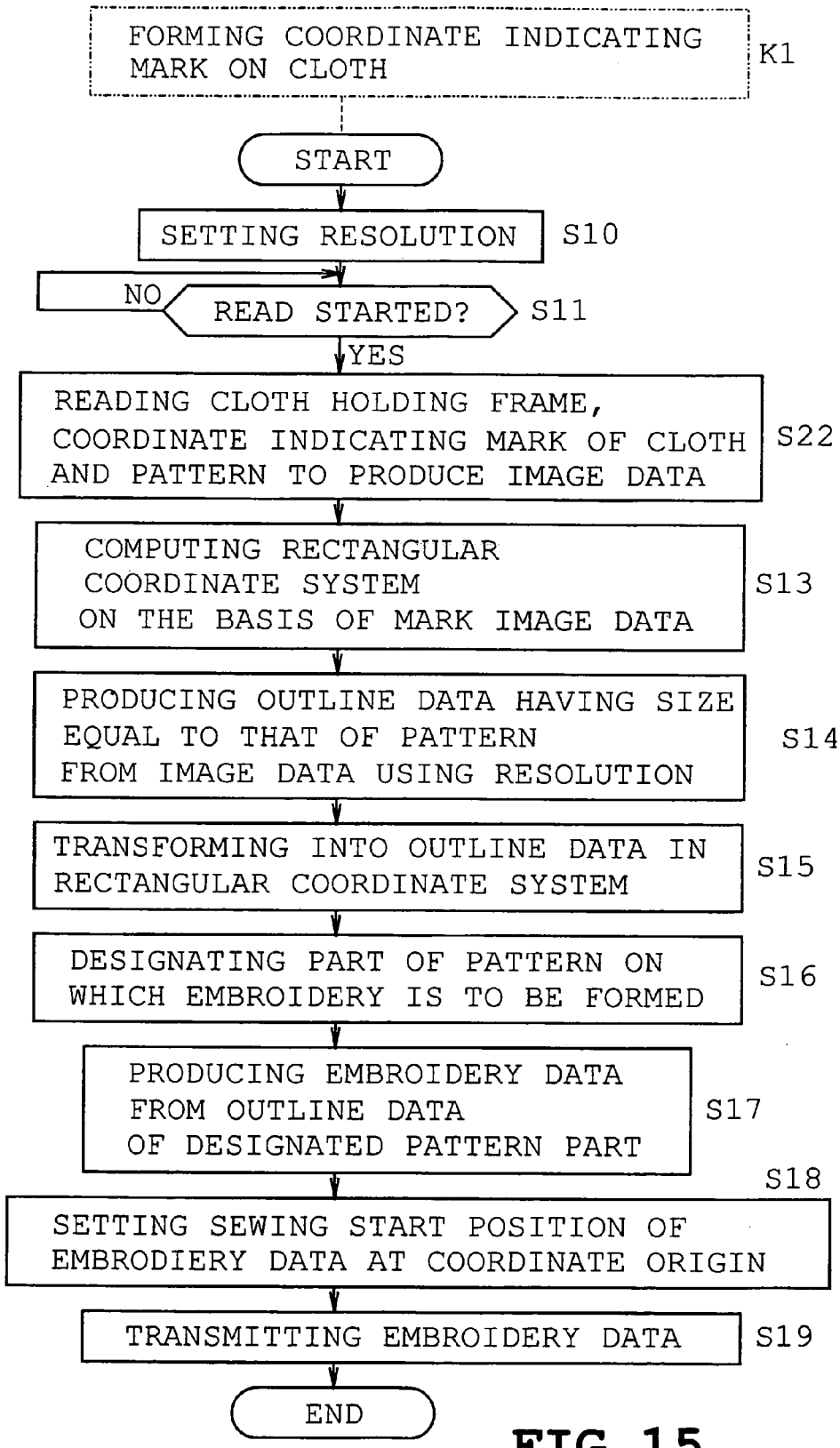
FIG. 15 is a view similar to FIG. 3.

FIG. 15 is a flowchart showing the control for producing the embroidery data. More specifically, a mark forming step K1 in which a coordinate indicating mark is formed on the cloth W is carried out before embroidery data producing process, instead of the previous step K0 in FIG. 3. Further, step S22 may be carried out so that the cloth holding frame 5A, a coordinate indicating mark MB of the cloth W and pattern F are read and image data of the cloth holding frame 5A, a coordinate indicating mark MB of the cloth W and pattern F are produced. Consequently, in the foregoing arrangement, too, the inclination of the pattern F can be corrected when the pattern F is read by the image scanner 15 and accordingly, the embroidery pattern formed on the basis of the embroidery data can accurately be positioned so as to correspond to a pattern to be embroidered of the cloth.

3. No coordinate indicating mark may be formed on the cloth holding frame or cloth. In this case, the cloth holding frame is read by the image scanner and image data of the cloth holding frame is produced. Values of X and Y axes are computed on the basis of the image data of the cloth holding frame, whereby the rectangular coordinate system (XY) in the cloth holding frame 5 is obtained.

4. When the embroidery sewing machine is provided with a plurality of types of cloth holding frames differing from each other in the shape and size, a frame number may be applied to every type of cloth holding frame, and the control device 20 may previously store frame information containing the sewing region E, sewing start position of the cloth holding frame and the like with the frame information corresponding to the frame number. The frame number may be supplied when embroidery data is produced on the basis of the image data of the cloth holding frame and pattern read by the image scanner. The sewing region E and sewing start position each corresponding to the supplied frame number are read to be utilized in the embroidery data producing process.

5. The cloth W may be cylindrical cloth such as a T-shirt when the embroidery sewing machine is provided with a cylindrical sewing bed.

6. In the embroidery data producing process as shown in FIG. 3, outline data is produced on the basis of image data (S14), and the coordinate transformation is carried out so that the outline data is transformed to the outline data in the rectangular coordinate system (XY). However, after the image data has been transformed to the outline data in the rectangular coordinate system (XY), outline data may be produced on the basis of the transformed image data.

7. In the foregoing embodiment, the portion of the cloth W on which the pattern F is printed is located over the inner frame 5*b*. However, the portion may be located below the inner frame 5*b*, instead. More specifically, when the inner frame 5*b* is fitted into the outer frame 5*a* from above with the cloth W being placed on the outer frame 5*a*, the cloth W is held by the cloth holding frame 5. In this case, when the cloth holding frame 5 holding the cloth W is set on the image scanner 15, the cloth W is located slightly higher than a reading face of the image scanner 15. However, since the thickness of the cloth holding frame 5 is very thin, the image scanner 15 can read the pattern F printed on the cloth W.

8. In the foregoing embodiment, the embroidery data producing program is provided on which the computer controlling the embroidery data producing device carries out the embroidery data producing process. The embroidery data producing program stored on a semiconductor memory, CD-ROM, CD-R or the like may be read and the control device 20 may execute the read embroidery data producing program. Further, a cable circuit or radio or wireless circuit may be used to read the embroidery data producing program from an external device.

9. The present invention should not be limited to the foregoing embodiment but various changes and modifications may be added to the embodiment without departing from the spirit of the invention. The present invention thus involves the changes and modifications in its scope.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery data producing device producing embroidery data on which an embroidery sewing machine forms an embroidery pattern along another pattern previously formed on cloth held by a cloth holding frame, the device comprising:

image data producing means for scanning the cloth held by the cloth holding frame to produce pattern image data corresponding to the another pattern; and embroidery data producing means for producing embroidery data for forming an embroidery pattern on at least a part of the pattern on the basis of the pattern image data, the embroidery pattern having a size equal to that of the another pattern.

2. The embroidery data producing device according to claim 1, wherein at least either one of the cloth holding frame and the cloth held by the cloth holding frame has a coordinate indicating mark indicative of a rectangular coordinate system in the embroidery sewing machine, the image data producing means scans the cloth holding frame and the cloth to produce mark image data corresponding to the coordinate indicating mark, and the embroidery data producing means is provided with image data transforming means for transforming the pattern image data into image data in the rectangular coordinate system on the basis of the mark image data and the pattern image data.

3. The embroidery data producing device according to claim 1, wherein at least either one of the cloth holding frame and the cloth held by the cloth holding frame has a coordinate indicating mark indicative of a rectangular coordinate system in the embroidery sewing machine, the image data producing means scans the cloth holding frame and the cloth to produce mark image data corresponding to the coordinate indicating mark, and the embroidery data producing means is provided with outline data producing means for producing outline data defining an outline of the pattern in the rectangular coordinate system on the basis of the mark image data and the pattern image data.

4. The embroidery data producing device according to claim 2, wherein the coordinate indicating mark is indicative of a specified position, and the embroidery data producing means is provided with sewing-start-position setting means for setting the specified position as a sewing start position for the embroidery data on the basis of the mark image data.

5. The embroidery data producing device according to claim 3, wherein the coordinate indicating mark is indicative of a specified position, and the embroidery data producing means is provided with sewing-start-position setting means for setting the specified position as a sewing start position for the embroidery data on the basis of the mark image data.

6. The embroidery data producing device according to claim 3, wherein the embroidery sewing machine has a rectangular sewing region for the cloth held by the cloth holding frame, the coordinate indicating mark is previously formed on the cloth holding frame so as to indicate two perpendicular directions, and an intersection of the two directions is located at any one of four corners and a central portion of the sewing region.

7. The embroidery data producing device according to claim 5, wherein the embroidery sewing machine has a rectangular sewing region for the cloth held by the cloth holding frame, the coordinate indicating mark is previously formed on the cloth holding frame so as to indicate two perpendicular directions, and an intersection of the two directions is located at any one of four corners and a central portion of the sewing region.

8. The embroidery data producing device according to claim 1, further comprising target part designating means for designating a part to be embroidered in the pattern on the cloth read by the image data producing means, wherein the embroidery data producing means produces embroidery data, corresponding to the target pattern part designated by the target part designating means.

9. A method of producing embroidery data on which an embroidery sewing machine forms an embroidery pattern along another pattern previously formed on cloth held by a cloth holding frame, the method comprising:

an image data producing step of scanning the cloth held by the cloth holding frame to produce pattern image data corresponding to the another pattern; and an embroidery data producing step of producing embroidery data for forming an embroidery pattern on at least a part of the pattern on the basis of the pattern image data, the embroidery pattern having a size equal to that of the another pattern.

10. The embroidery data producing method according to claim 9, further comprising a mark forming step of forming a coordinate indicating mark on at least either one of the cloth holding frame and the cloth held by the cloth holding frame, the coordinate indicating mark being indicative of a rectangular coordinate system in the embroidery sewing machine, the mark forming step being carried out prior to the image data producing step, wherein in the image data producing step, the cloth holding frame and the cloth are scanned to produce mark image data corresponding to the coordinate indicating mark; in the embroidery data producing step, the pattern image data is transformed into image data in the rectangular coordinate system on the basis of the mark image data and the pattern image data; and the embroidery data is produced on the basis of the transformed image data.

11. The embroidery data producing method according to claim 9, further comprising a mark forming step of forming a coordinate indicating mark on at least either one of the cloth holding frame and the cloth held by the cloth holding frame, the coordinate indicating mark being indicative of a rectangular coordinate system in the embroidery sewing machine, the mark forming step being carried out prior to the image data producing step, wherein in the image data producing step, the cloth holding frame and the cloth are scanned to produce mark image data corresponding to the coordinate indicating mark; in the embroidery data producing step, outline data defining an outline of the pattern in the rectangular coordinate system is produced on the basis of the mark image data and the pattern image data; and the embroidery data is produced on the basis of the outline data.

12. The embroidery data producing method according to claim 10, wherein the coordinate indicating mark is indicative of a specified position, and the embroidery data producing step includes a sewing-start-position setting step of setting the specified position as a sewing start position for the embroidery data on the basis of the mark image data.

13. The embroidery data producing method according to claim 11, wherein the coordinate indicating mark is indicative of a specified position, and the embroidery data producing step includes a sewing-start-position setting step of setting the specified position as a sewing start position for the embroidery data on the basis of the mark image data.

14. The embroidery data producing method according to claim 12, wherein the embroidery sewing machine has a rectangular sewing region for the cloth held by the cloth holding frame, the coordinate indicating mark is previously formed on the cloth holding frame so as to indicate two perpendicular directions, and an intersection of the two directions is located at any one of four corners and a central portion of the sewing region.

15. The embroidery data producing method according to claim 13, wherein the embroidery sewing machine has a rectangular sewing region for the cloth held by the cloth holding frame, the coordinate indicating mark is previously formed on the cloth holding frame so as to indicate two perpendicular directions, and an intersection of the two directions is located at any one of four corners and a central portion of the sewing region.

16. The embroidery data producing method according to claim 9, further comprising a target part designating step of designating a part to be embroidered in the pattern on the cloth read by the image data producing step, wherein in the embroidery data producing step, embroidery data is produced so as to correspond to the target pattern part designated in the target part designating step.

17. An embroidery data producing program which is stored on a computer-readable medium and on which a computer executes an embroidery data producing process, the computer controlling an embroidery data producing device for producing embroidery data on which an embroidery sewing machine forms an embroidery pattern along another pattern previously formed on cloth held by a cloth holding frame, the program comprising:

an image data producing routine of scanning the cloth held by the cloth holding frame to produce pattern image data corresponding to the another pattern; and an embroidery data producing routine of producing embroidery data for forming an embroidery pattern on at least a part of the pattern on the basis of the pattern image data, the embroidery pattern having a size equal to that of the another pattern.

18. The embroidery data producing program according to claim 17, wherein at least either one of the cloth holding frame and the cloth held by the cloth holding frame has a coordinate indicating mark indicative of a rectangular coordinate system in the embroidery sewing machine; in the image data producing routine, the cloth holding frame and the cloth are scanned so that mark image data corresponding to the coordinate indicating mark is produced; and the embroidery data producing routine includes an image data transforming routine transforming the pattern image data into image data in the rectangular coordinate system on the basis of the mark image data and the pattern image data.

19. The embroidery data producing program according to claim 17, wherein at least either one of the cloth holding frame and the cloth held by the cloth holding frame has a coordinate indicating mark indicative of a rectangular coordinate system in the embroidery sewing machine; in the image data producing routine, the cloth holding frame and the cloth are scanned so that mark image data corresponding to the coordinate indicating mark is produced; and the embroidery data producing routine includes an outline data producing routine producing outline data defining an outline of the pattern in the rectangular coordinate system on the basis of the pattern image data.

20. The embroidery data producing program according to claim 18, wherein the coordinate indicating mark is indicative of a specified position, and the embroidery data producing routine includes a sewing-start-position setting routine setting the specified position as a sewing start position for the embroidery data on the basis of the mark image data.

21. The embroidery data producing program according to claim 19, wherein the coordinate indicating mark is indicative of a specified position, and the embroidery data producing routine includes a sewing-start-position setting routine setting the specified position as a sewing start position for the embroidery data on the basis of the mark image data.

22. An embroidering method executed by an embroidery sewing machine for forming an embroidery pattern along another pattern previously formed on cloth held by a cloth holding frame on the basis of embroidery data, the method comprising:

a step of forming a coordinate indicating mark on at least either one of the cloth holding frame and the cloth held by the cloth holding frame, the coordinate indicating mark being indicative of a rectangular coordinate system and a specified position in the embroidery sewing machine;

a step of scanning the cloth holding frame and the cloth to produce pattern image data and mark image data corresponding to the pattern and the coordinate indicating mark respectively;

a step of obtaining the rectangular coordinate system on the basis of the mark image data;

a step of producing outline data defining an outline of the pattern on the basis of the pattern image data;

a step of transforming the outline data into outline data in the rectangular coordinate system;

a step of producing embroidery data on the basis of the transformed outline data so that the specified position corresponds to a sewing-start-position of the embroidery data, the embroidery data serving for forming an embroidery pattern on at least a part of the pattern, the embroidery pattern having a size equal to that of the pattern; and a step of moving the cloth holding frame so that a sewing needle of the embroidery sewing machine is located at the specified position when the sewing machine starts a sewing operation on the basis of the embroidery data.

* * * * *